US005502938A

United States Patent [19]

Backer

[11] Patent Number: 5,502,938

[45] Date of Patent: Apr. 2, 1996

[54] MODULAR WALL ASSEMBLY SYSTEM AND ELASTIC HINGE THEREFOR

[76] Inventor: Bruce E. Backer, 4430 Del Monte Ave., San Diego, Calif. 92110

[21] Appl. No.: 15,352

[22] Filed: Feb. 8, 1993

[51] Int. Cl.[6] ..... E04B 1/00

[52] U.S. Cl. ..... 52/281; 52/71; 52/582.1; 16/225

[58] Field of Search ..... 52/582.1, 71; 16/225, 16/272, 385, DIG. 13; 160/135, 199, 201, 206, 231.1, 231.2

[56] References Cited

U.S. PATENT DOCUMENTS

| | | | |
|---|---|---|---|
| 2,607,411 | 8/1952 | Van Vliet | 16 X/225 |
| 3,132,432 | 5/1964 | Yee | 160/135 X |
| 3,889,736 | 6/1975 | Firks | 16 X/225 |
| 4,131,971 | 1/1979 | Saarloos | 16/225 |
| 4,438,605 | 3/1984 | De Lucia | 16 X/225 |
| 4,670,938 | 6/1987 | Fowlston | 16/225 |
| 4,679,277 | 7/1987 | Shibata | 16 X/382 |
| 4,726,155 | 2/1988 | Nahmias | 52/71 |
| 4,747,441 | 5/1988 | Apolzer | 160/206 |
| 4,986,038 | 1/1991 | Backer | 52/71 |
| 5,015,028 | 5/1991 | Bonnett | 16 X/225 |
| 5,050,663 | 9/1991 | Rhoads | 16 X/225 |
| 5,133,108 | 7/1992 | Esnault | 16/225 |
| 5,148,850 | 9/1992 | Urbanick | 16 X/225 |

*Primary Examiner*—Carl D. Friedman
*Assistant Examiner*—Beth A. Aubrey
*Attorney, Agent, or Firm*—Stanley A. Becker

[57] ABSTRACT

A modular wall assembly system includes a hinge assembly for connecting modular panels. The panels each have a channel member formed or recessed in a vertical edge. The hinge assembly includes a first hinge plate and a second hinge plate which are connected by an elastomeric member. Each hinge plate has a pair of projecting flanges which slidably engage the channel member. The channel member may have enlarged openings to permit insertion of the projecting flanges intermediate the ends of the channel member. The hinge assembly has two pivot points which are variable due to the elasticity of the elastomeric member. The elastomeric member allows the panels to move angularly and laterally with respect to one another.

28 Claims, 3 Drawing Sheets

FIG. 5
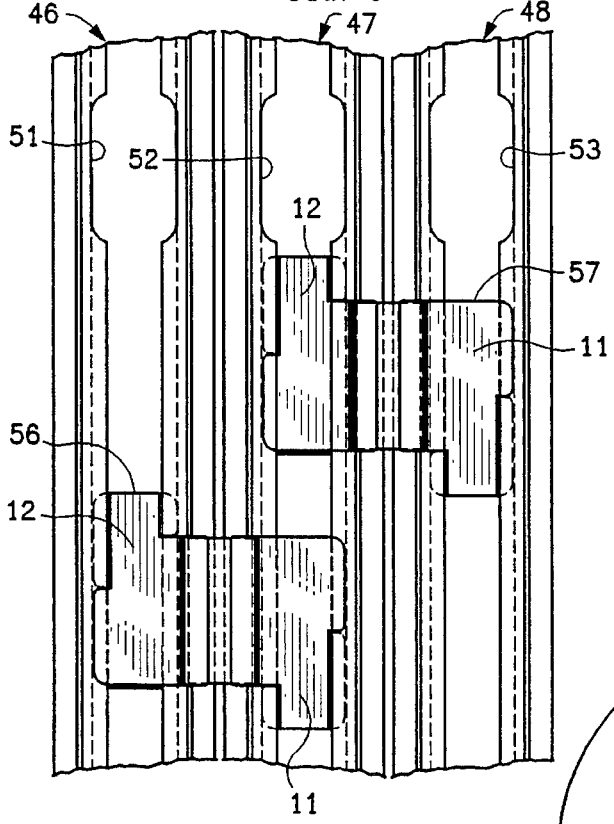
FIG. 6a
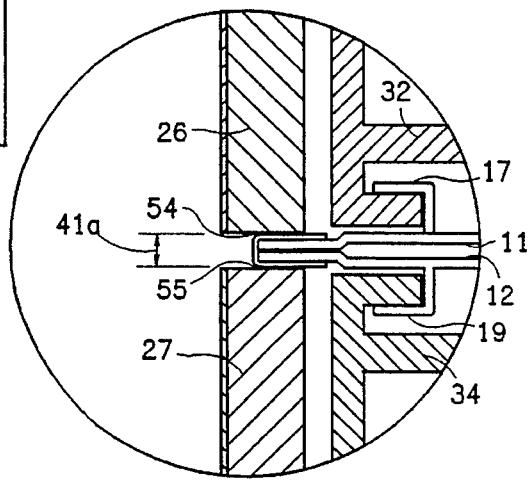
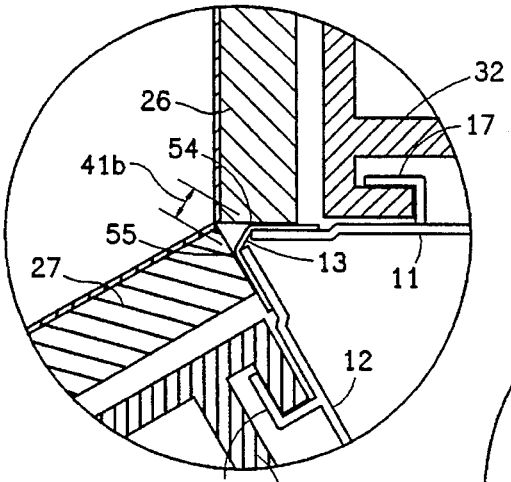
FIG. 6b
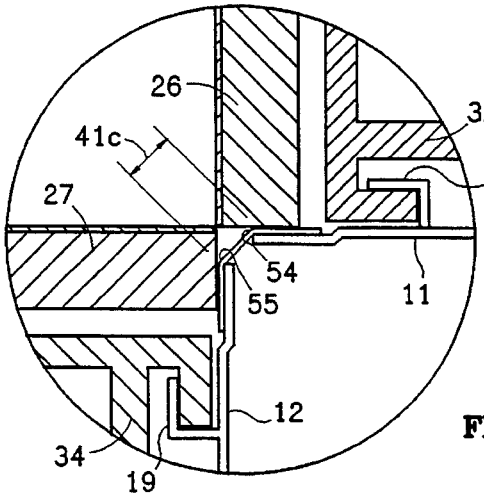
FIG. 6c

MODULAR WALL ASSEMBLY SYSTEM AND ELASTIC HINGE THEREFOR

BACKGROUND OF THE INVENTION

1. Field of the Invention

This invention relates generally to portable wall structures, and more particularly to the interconnection of lightweight modular panels by an elastic hinge to allow the panels to be positioned in angular relationship relative to one another.

2. Discussion of Prior Art

In recent years, the related fields of trade show and exhibit booths and office interiors have turned to modular construction for the panel and wall systems. In these modular systems, interconnecting panels are assembled into a variety of shapes and enclosures. The principal characteristic of these systems is their ability to form many different sizes and shapes of enclosures depending on the particular types of panels chosen, plus their ability to be assembled, disassembled, and reassembled into different shapes rapidly and easily.

Earlier inventions of the inventor herein, shown in U.S. Pat. No. 4,712,336, incorporated herein by reference, and U.S. Pat. No. 4,986,038, also incorporated herein by reference, disclose panel interconnection systems including hardware for interconnecting panels easily and rapidly without the use of tools. The foregoing patents disclose hardware which interconnect the panels at the ends of the panels. The systems described in the foregoing patents were originally designed as a system of stacking panels, connected both vertically and horizontally at the ends of channels which are recessed into the panel's vertical edges. Assembling tall wall sections is accomplished by stacking short panels with fixed or hinging intermediate connectors made at the junctions. In installing such stacked, short panels, installers should first make all horizontal connections with the lower level panels prior to the assembly of the next level of panels. Horizontal connections at the bottom of the panels are difficult after assembly of the structure.

It has been found necessary to provide interconnections intermediate the ends of panels, particularly for tall panels which are typically eight feet high or more. Such panels are difficult to maintain in lateral alignment if connected only at their ends. Prior art connectors which interconnect panels intermediate the ends of the panels do not hinge and some require tools in order to join the panels or attach connectors. Such prior art connectors include bolt and wingnut assemblies, which do not hinge. There are also rotationally engaging lock assemblies such as roto-locks, noris fasteners, and gyrobolts which use a hooking device that rotates and cinches onto a receptor bar to clamp panels adjacently. These also do not hinge and require a tool to engage the lock. Conventional hinges can be fastened to the edges of adjacent panels with screws or clamps, but these require tools, it is time-consuming to install and the hinge is visible from the panel face. Another prior art connector is a spline which can be inserted into vertical channels of adjacent panels. These are difficult to install due to friction in the long channel and the need for high-ceiling requirements. Typically the prior art connectors also create relatively large spaces between the panels, thus the connectors are visible from the display surface. All of the prior arts system have significant disadvantages. They require tools for assembling, are difficult or time consuming to install, are visible from the panel face, do not hinge or some combination of the foregoing.

It is desirable to have a hinge that interconnects the modular panels easily and without the use of tools; is recessed from the panel face to be hidden from view; minimizes gaps between panels when in a linear configuration and has no gap in an angular configuration; maintains positive lateral tension on the panels to assure alignment and establish a stable, firm feel; can be used singly to horizontally connect two panels or with additionally hinges to connect multiple panels at the same junction; can connect panels of dissimilar heights by means either at the ends of the channels, intermediate the ends of the channel or a combination of both; and allows additional hinged connections to be accomplished after a structure has been assembled.

SUMMARY OF THE INVENTION

The present invention relates to a new and novel panel connection system in which tall panels can be interconnected by a hinge assembly intermediate their ends without tools, and with the hinge being recessed from the panel face. The system of this invention includes a plurality of panels, each having a channel along its vertical edge. The channel could be formed in the frame of the panel or a channel member could be installed in a recess in the vertical edge of a panel. The channel member may run the full length of the vertical edge or if desired may comprise a plurality of channel pieces which are in vertical alignment with one another. Each channel member or channel piece has a plurality of enlarged openings formed therein at spaced intervals along its length. A hinge assembly, as will be more fully described hereinafter, is fitted into the enlarged opening and moved longitudinally along the channel member so that it engages the channel member in locking relationship. A second panel to be interconnected to the first panel similarly has a channel member recessed into one vertical edge which is positioned adjacent to the channel member of the first panel. Flanges on the hinge assembly are moved into engagement with the enlarged opening in channel member of the second panel and moved along the channel member so that it moves into locking relationship whereupon the two panels are hinged together. The hinge plate engaged with the first panel is interconnected to the hinge member which is engaged with the second channel by an elastomeric material which allows the hinge plates to move angularly and laterally with respect to each other thereby allowing the panels to be positioned in any desired angular relationship.

The preferred embodiment of the hinge assembly of this invention includes a first hinge plate having a pair of flanges formed therein for fitting into the channel member of a first panel, and a second hinge plate having a pair of flanges formed therein for fitting into the channel member of a second panel. The first hinge plate also has a tab projecting therefrom which is slightly smaller in dimension than the width of the channel opening so that when it moves into engagement with the channel opening it assures alignment of the hinge plate parallel to the channel. The second hinge plate has a similar tab at opposite ends to the first tab. Each hinge plate has a recessed portion which receives an elastomeric material which is adhesively bonded thereto or fastened by other means. The elastomeric material serves as the hinge for the hinge assembly.

In use, the first hinge plate is moved into alignment with an enlarged opening in the channel member of a first panel and is moved longitudinally such that the flanges move into engagement with the channel member and lock the hinge plate relative thereto. The second hinge plate is similarly mounted to the channel of a second panel. The first and second panels are interconnected after one or more hinge assemblies are inserted therein, and can be moved angularly relative to one another.

Further aspects of the present invention will become apparent from the following detailed description when considered in conjunction with the accompanying drawings. It should be understood, however, that the detailed description and the specific examples while representing the preferred embodiments are given by way of illustration only.

BRIEF DESCRIPTION OF THE DRAWINGS

FIG. 5 illustrates a plurality of panels which can be interconnected by the hinge assembly of the invention.

FIG. 6 shows three enlarged views illustrating the stretching of the elastomeric hinge material when the hinge assembly is closed, when it is open 60 degrees, and when it is open 90 degrees, and shows the changing distance between pivot points depending on the angular orientation.

DETAILED DESCRIPTION OF THE INVENTION

The following description is of the best, presently contemplated modes of carrying out the invention. This description is made for the purpose of illustrating the general principles of the invention and should not be taken in a limited sense.

Figure 1:
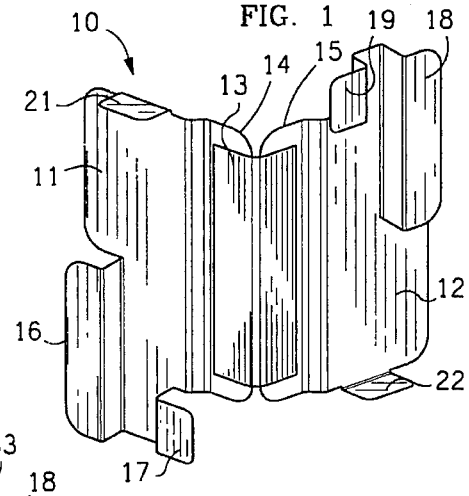
FIG. 1 is a perspective view of a preferred embodiment of the hinge assembly which is the subject of this invention.

In accordance with the present invention, FIG. 1 illustrates a hinge assembly generally designated as 10 having a first hinge plate 11 positioned adjacent to a second hinge plate 12. Hinge plate 11 is connected to the hinge plate 12 by a hinge 13 made of an elastic or elastomeric material which is adhesively or mechanically bonded to recessed portions 14 and 15 of hinge plate 11 and hinge plate 12 respectively. Although recessed portions 14 and 15 are shown to accommodate the hinge material, they are not required. A preferred elastomeric material is polyurethane. Other elastic materials could be utilized. The elastic hinge material can be stretched or expanded to allow for constant and positive contact of hinging parts that have minor variations in dimensions, tolerance, and orientation. Further, the elastic hinge material allows for low profile hinge assembly parts to be used to minimize separation of the panels. Additionally, the hinge of this invention is designed with two pivot points connected with an elastic material that allows the points to vary in relation to each other based on the spaced relationship of one panel relative to the other. Prior art hinges have fixed pivot points or pre-engineered paths of rotation. The prior art hinge plates pivot in relation to themselves (whether attached to panels or not) and have no relationship to the panels being hinged or means for accommodating dimensional variations. The subject hinge assembly does not hinge in a fixed relationship to its opposing parts. Instead, it allows the panels that are being hinged to determine the pivot points of the hinge, thereby naturally obtaining positive contact between the parts with the following advantages: minimal gaps between panels because pivot points are recessed from the face of the panels and the tension of the elastic material holds the panel edges tightly together; and allows for thickness variation of finish coverings (fabric vs. laminate) while maintaining positive contact in all hinged orientations.

The first hinge plate 11 has a pair of flanges 16 and 17 formed therein to engage the channel member of a panel. If desired, flanges can be formed from a separate piece of material and riveted, welded or otherwise attached to the hinge plate in lieu of forming the flanges from one piece as shown. A similar pair of flanges 18 and 19 are formed on the second hinge plate 12, but they are formed in offsetting relationship to the flanges 16 and 17. The offset flanges simplify installation by allowing positioning of the flanges of one hinge plate in the channel member of one panel prior to engaging the flanges of the second hinge plate in the channel member of a second panel. It is to be noted that hinge plate 11 is the same as hinge plate 12, except that is is rotated 180 ° before assembly. This permits both parts to be made with one die. If desired, one hinge plate could be fixed to one panel by screws or other fasteners, and the other hinge plate could fit into the channel of a second panel as described above.

A tab 21 is formed on hinge plate 11 to slide within the channel opening and prevent twisting of the hinge plate 11. The tab 21 is slightly smaller than the width of the channel opening. A similar tab may be formed on the other end of the hinge plate 11 if desired, but it is not believed necessary.

A tab 22 is formed on the hinge plate 12 at the end opposite to the tab 21 formed on hinge plate 11. The use of these oppositely formed tabs 21 and 22 allow the hinge assembly 10 to be placed into the adjacent channels member of two panels and prevent twisting of the hinge assembly 10 after installation.

Figure 2:
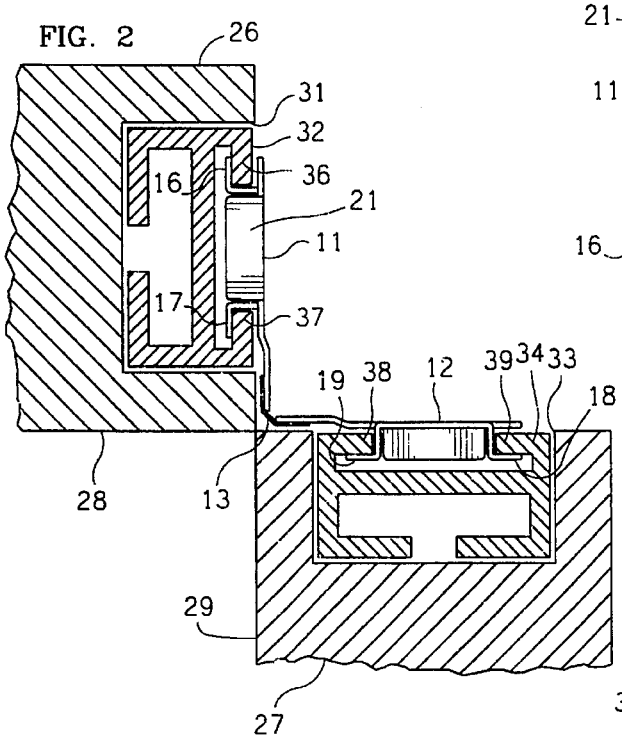
FIG. 2 is a cross-sectional view showing a pair of panels interconnected at a ninety degree angular relationship with the hinge assembly of this invention.

Referring to FIG. 2, there is shown first panel 26 and second panel 27. The panels 26 and 27 are typically made of wood, a rigid polymer, or other rigid materials and have a face 28 and 29 respectively which are covered with fabric or other decorative material which is not shown. One end of the first panel 26 has a recess 31 formed therein in which a channel member 32 is mounted. The channel member 32 is formed of rigid material, preferably extruded light-weight aluminum or the equivalent. However, it is possible that the channel member 32 could be made of rigid plastic or other material of suitable strength characteristics. Also, it is possible that the channel could be formed integrally with the frame of a panel. The channel 32 is attached to the frame 26 by any appropriate means such a plurality of screws, which are not shown. Similarly, the end of panel member 29 has a recess 33 formed therein which has a channel member 34 attached thereto as previously described.

Channel member 32 is formed with inwardly facing projections 36 and 37. Channel member 34 is formed with inwardly facing projections 38 and 39. The flanges 16 and 17 of the hinge plate 11 engage the projections 36 and 37 of channel member 32 to lock the first hinge into the channel so that it can move slidably therein after it is installed. The projections of each channel member are cut away at various positions along the length of the channel to allow installation of the hinge assembly 10 between the ends of the channel member. This is described more fully in connection with FIG. 4. The tab 21 of hinge plate 11 which as shown in FIG. 2 is aligned in the opening between the projections 36 and 37 of channel member 32. The tab 22 of hinge plate 12 is aligned in the opening between projections 38 and 39 of channel member 34. Tabs 21 and 22 prevent twisting of each hinge plate relative to its associated channel member. It is apparent from viewing FIG. 2 that the panel members 26 and 27 can be positioned in any angular relationship from 180 degrees, where the hinge assembly is completely closed and the panels are in alignment, to a position where an acute angle is formed between the two panel faces 28 and 29.

Figure 3:
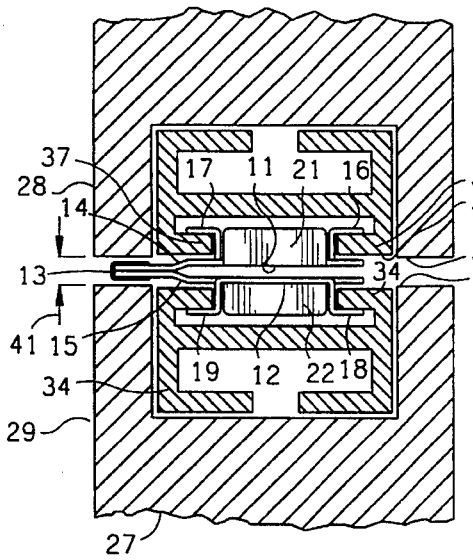
FIG. 3 is a cross-sectional view illustrating a first and second panel interconnected with the hinge assembly closed so that the panel faces are in alignment.

Referring now to FIG. 3, the hinge assembly 10 is shown in a closed position with the panel faces 28 and 29 being in alignment. It is to be noted that the elastomeric material of hinge 13 easily stretches and that the thinness of the hinge plates 11 and 12 and the elasticity of the hinge 13 allows the space generally designated as 41 between the first and second panels 26 and 27 to be relatively small. This allows the pivot points to be recessed. Thus, the hinge assembly 10 is hardly visible when looking at the faces 28 and 29 of the panels. Referring to FIG. 2, where the hinge assembly 10 is positioned at a ninety degree angle, it can be seen that the adjacent edges of the panels 26 and 27 are in a touching, relationship and that the hinge assembly 10 is invisible. It is to be understood that although the discussion herein refers to a hinge assembly, it is desirable that a plurality of hinge assemblies be used to interconnect two panels.

In use, the hinge assemblies of the subject invention are typically used where it is desired to have adjacent panels in some relationship other than a straight alignment. However, the hinge assemblies, as shown in FIG. 3, can easily be used to accommodate this as well as angular relationships.

Figure 4:
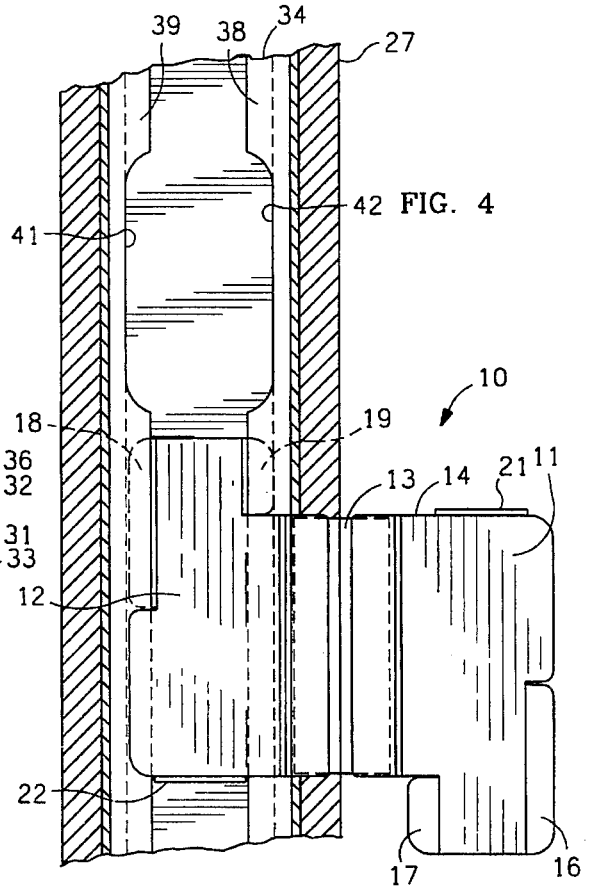
FIG. 4 is a side view illustrating the enlarged opening of the channel member of one panel and the interlocking relationship of the hinge assembly to the channel member.

Referring to FIG. 4, the channel member 34 can be seen installed in the end of panel 27. The projections 38 and 39 are shown cutaway at 41 and 42 respectively to form a recessed portion which allows the flanges 16 and 17 of the hinge plate 11 to be inserted therein and moved upwardly or downwardly to position the hinge assembly 10 in any desired position along the channel member.

FIG. 5 shows a plurality of panels 46, 47, and 48, each of which has a plurality of recesses 51, 52, and 53 formed at spaced intervals along each respective channel member. As shown in FIG. 5, hinge assembly 56 interconnects panels 46 and 47. Hinge assembly 57 interconnects panels 47 and 48. The hinge assemblies allows panels 46 and 47 to have any desired angular relationship there between and also permits panel 48 to be positioned in any desired angular relationship to panel 47.

Referring to FIG. 6, there are shown enlarged views of two panels in different angular relationships. In FIG. 6(*a*), the hinge assembly is shown fully closed with the panels 26 and 27 being in alignment with one another. The hinge points are 54 and 55. It is to be noted that the space 41(*a*) between the panels is relatively small and the hinge points 54 and 55 are close together. In FIG. 6(*b*), the panels 26 and 27 are shown in angular relationship with a 60 degree angle formed between the hinge plates 11 and 12. The hinge points 54 and 55 are now further apart. The dimension 41(*b*) is now larger due to the stretch of the hinge 13 between the hinge plates 11 and 12. When the panels 26 and 27 are moved to a 90 degree position as shown in FIG. 6(*c*), the stretch of the hinge 13 becomes more apparent when looking at the dimension 41(*c*) which becomes larger due to the movement of the panels into this 90 degree relationship. Again, the hinge points 54 and 55 are still further apart. The ability of the elastomeric material of the hinge 13 to easily accommodate these positions is apparent from the drawings.

Figure 7A:
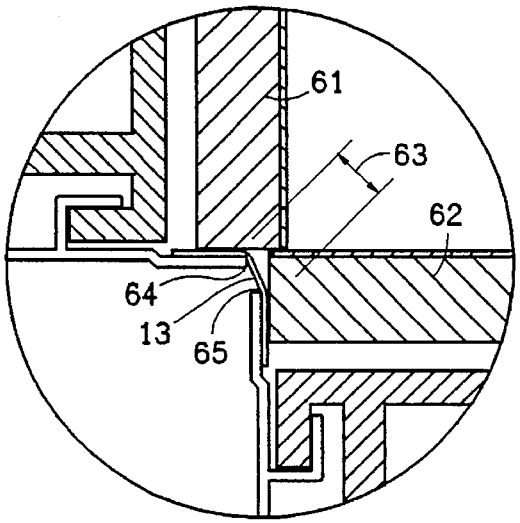
FIG. 7 shows two enlarged views of the hinge assembly illustrating the accommodation of offset panel alignment and interconnecting panels of different thickness.
Figure 7B:
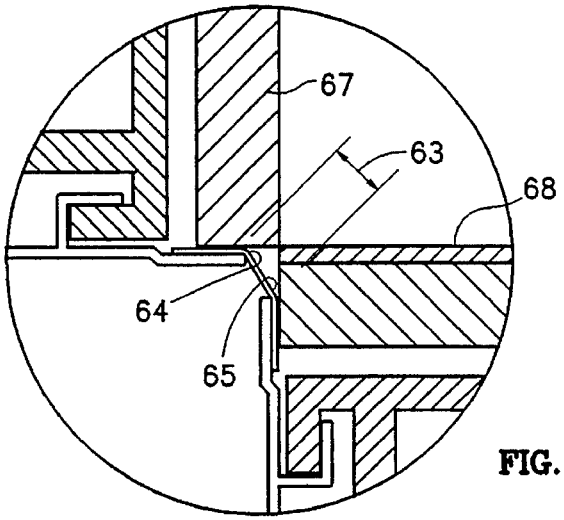

Additionally, as shown in FIG. 7, the hinge assembly of this invention can even accommodate offset panel alignment. Referring to FIG. 7(*a*), there is shown two panels 61 and 62 which are in offset alignment. The elasticity of the hinge 13 is able to accommodate this offset alignment as evidenced by the width of the dimension 63. Similarly, as shown in FIG. 7(*b*), panels 67 and 68 of varying thickness can be used because of the elasticity of the hinge 13 which allows the hinge points to separate to accommodate hinging of panels of various thickness.

Figure 8:
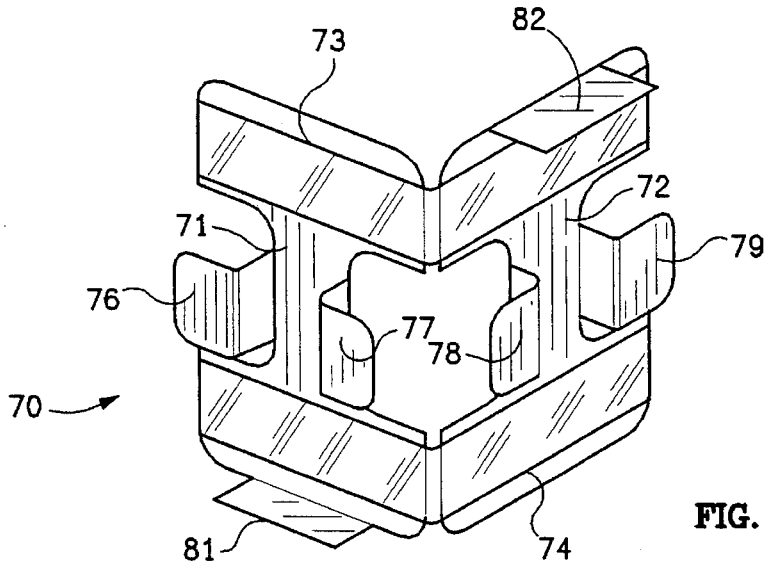
FIG. 8 is an alternative embodiment of the hinge assembly of the invention.

An alternative embodiment of the hinge assembly of this invention is shown in FIG. 8. A hinge assembly generally designated as 70 is shown having a first hinge plate 71 and second hinge plate 72. The hinge plates 71 and 72 are interconnected by two hinges 73 and 74 of an elastomeric material. Hinge plate 71 has a pair of flanges 76 and 77 which engage a channel member in a panel. Hinge plate 72 has a pair of flanges 78 and 79 for similar engagement with a channel member of another panel. The flanges 76 and 77 are offset from the flanges 78 and 79 to allow for easy installation. Hinge plate 71 also has a tab 81 which rides in the channel opening to prevent twisting. Similarly, hinge plate 72 has a tab 82 at the opposite end from tab 81 which rides in the channel opening of another panel.

Although the present invention has now been described in terms of certain preferred embodiments and exemplified with respect thereto, one skilled in the art will readily appreciate the various modifications, changes, omissions and substitutions may be made without departing from the spirit of the invention. It is intended therefor that the present invention be limited solely by the scope of the following claims.

What is claimed is:

1. A panel connection system comprising:

a plurality of panels each having a front and a back surface and at least one vertical edge positioned adjacent to a vertical edge of another panel; and a plurality of hinge assemblies each having a first and a second hinge plate positioned adjacent to each other, said first hinge plate having means for connecting flat against the vertical edge of a first panel, said second hinge plate having means for connecting flat against the vertical edge of a second panel, said first and second hinge plates connected by at least one elastomeric member recessed from the adjacent front or back surfaces of each panel to allow the first and second panels to be interconnected and move angularly and laterally with respect to each other.

2. A panel connection system as set forth in claim 1 wherein at least one of the panels to be interconnected has a recess formed in a vertical edge thereof and a hollow channel member mounted within said recess having an outer side flush with the vertical edge of said panel and said corresponding hinge plate connecting means includes means for sliding within said hollow portion of said channel member to interlock the hinge plate to said channel member.

3. A panel connection system as set forth in claim 2 wherein the outer side of said channel has a plurality of openings formed along its length of a size sufficient to receive said sliding means to allow said hinge plate to be connected to said channel intermediate the ends thereof.

4. A panel connection system as set forth in claim 2 wherein said sliding means comprises a pair of projecting flanges which engage said channel.

5. A panel connection system as set forth in claim 4 wherein said pair of projecting flanges are of equal length.

6. A panel connection system as set forth in claim 2 wherein said outer side of said channel member has a longitudinal opening formed therein and said corresponding hinge plate includes a projecting tab which is received within said longitudinal opening of the channel.

7. A panel connection system as set forth in claim 1 wherein each panel has a hollow channel member recessed into at least one vertical edge thereof, said channel member having a longitudinal opening formed therein, and each hinge plate connecting means includes a pair of flanges which project from said hinge plate through said longitudinal opening in said channel and which slidably engage said channel.

8. A panel connection system as set forth in claim 7 wherein each channel member has a plurality of enlarged openings formed along the longitudinal opening for receiving the projecting flanges so that said flanges can slide into engagement with the channel member intermediate the ends thereof.

9. A panel connection system as set forth in claim 8 wherein each of said hinge plates includes a projecting tab which is received within the longitudinal opening in said channel member.

10. A panel connection system as set forth in claim 9 wherein the projecting tab on the first hinge plate is formed on the top thereof and the projecting tab on the second hinge plate is formed on the bottom thereof.

11. A panel connection system as set forth in claim 8 wherein the projecting flanges on each hinge plate are of unequal length.

12. A panel connection system as set forth in claim 8 wherein the projecting flanges on each hinge plate are of equal length.

13. A panel connection system as set forth in claim 1 wherein a plurality of elastomeric members connect said first hinge plate to said second hinge plate.

14. A panel connection system as set forth in claim 8 wherein said projecting flanges of said first hinge plate are offset from said projecting flanges of said second hinge plate.

15. A panel connection system as set forth in claim 7 wherein a center panel is connected to a panel on each side thereof by at least two hinge assemblies, the first hinge assembly having said first hinge plate engaged in the channel of said center panel and said second hinge plate engaged in the channel of the panel to one side thereof, the second hinge assembly having said second hinge plate engaged in the channel of said center panel and the first hinge plate engaged in the channel of the panel to the other side of said center panel.

16. A panel connection system comprising:

a plurality of panels;

a channel member recessed into at least one vertical edge of each panel, each channel member having a longitudinal opening formed therein with said longitudinal opening being enlarged at spaced intervals along its length;

a hinge assembly having a first hinge plate interconnected by an elastomeric member to a second hinge plate, said elastomeric member recessed from the face of the panels, said first hinge plate having a pair of projecting flanges which fit into the enlarged openings of the channel member of one panel and move into sliding engagement with said channel member, said second hinge plate having a pair of projecting flanges which fit into one of the enlarged openings of the channel member of another panel and move into sliding engagement with said other channel member, said hinge assembly joining said first panel and allowing said first and second panels to be positioned in angular relationship with one another.

17. A hinge assembly for interconnecting a plurality of panels each having a front and back surface and at least one vertical edge positioned adjacent to a vertical edge of another panel comprising:

a first hinge plate having means for connecting flat against the vertical edge of one panel;

a second hinge plate positioned adjacent to said first hinge plate having means for connecting flat against the vertical edge of a second panel; and an elastomeric member, bonded to said first and second hinge plates to hold said panels together in any desired angular relationship with said elastomeric member recessed from the adjacent front or back surfaces of said panels, said elastomeric member being stretchable to accommodate lateral displacement between the panels.

18. A hinge assembly as set forth in claim 17 wherein at least one of the panels to be interconnected has a hollow channel formed in a vertical edge thereof and said first hinge plate has means for slidably engaging said channel.

19. A hinge assembly as set forth in claim 17 wherein each of the panels to be interconnected has a hollow channel formed in the adjacent vertical edges and said first and second hinge plates each have a pair of projecting flanges which slide within the hollow channel of one of the panels.

20. A hinge assembly as set forth in claim 19 wherein said projecting flanges of said first hinge plate are offset from said projecting flanges of said second hinge plate.

21. A hinge assembly system as set forth in claim 17 wherein a plurality of elastomeric members hold said first and second hinge plates together.

22. A hinge assembly as set forth in claim 19 wherein the projecting flanges of each hinge plate are of unequal length.

23. A hinge assembly as set forth in claim 19 wherein each channel has a longitudinal opening formed therein connecting with the hollow portion of said channel and wherein each hinge plate has a tab projecting therefrom which is received within the longitudinal opening of said channel to prevent twisting of the hinge plate.

24. A hinge assembly as set forth in claim 23 wherein the tab of said first hinge plate is at the top thereof and the tab of said second hinge plate is at the bottom thereof.

25. A hinge assembly as set forth in claim 17 wherein the first hinge plate has a pivot point at the juncture of the elastomeric member and the edge of the first hinge plate, and the second hinge plate has a pivot point at the juncture of the elastomeric member and the edge of the second hinge plate, and the distance between said first and second pivot points is variable due to the elasticity of the elastomeric member.

26. A hinge assembly as set forth in claim 17 wherein said first hinge plate is identical to said second hinge plate but is rotated 180° before being interconnected by said elastomeric member.

27. A hinge assembly as set forth in claim 25 wherein each of the panels to be interconnected has a hollow channel member recessed into at least one vertical edge thereof and each hinge plate includes a pair of projecting flanges which slide within said channel member.

28. A hinge assembly as set forth in claim 27 wherein each channel member has a plurality of enlarged openings along its length for receiving the projecting flanges of said hinge plate intermediate the ends of said channel member.

* * * * *